US010481559B2

(12) United States Patent
Cheung

(10) Patent No.: US 10,481,559 B2
(45) Date of Patent: Nov. 19, 2019

(54) HYBRID ANALOG WATCH

(71) Applicant: Debreu Limited, Hong Kong (CN)

(72) Inventor: David Cheung, Kwai Chung N.T. (CN)

( * ) Notice: Subject to any disclaimer, the term of this patent is extended or adjusted under 35 U.S.C. 154(b) by 102 days.

(21) Appl. No.: 15/573,524

(22) PCT Filed: Oct. 20, 2016

(86) PCT No.: PCT/CN2016/102641
§ 371 (c)(1),
(2) Date: Nov. 13, 2017

(87) PCT Pub. No.: WO2017/088612
PCT Pub. Date: Jun. 1, 2017

(65) Prior Publication Data

US 2018/0101137 A1 Apr. 12, 2018

Related U.S. Application Data

(60) Provisional application No. 62/259,150, filed on Nov. 24, 2015.

(51) Int. Cl.
*G04C 3/14* (2006.01)
*G04R 20/26* (2013.01)
*G04R 60/14* (2013.01)

(52) U.S. Cl.
CPC ..... *G04C 3/146* (2013.01); *G04R 20/26* (2013.01); *G04R 60/14* (2013.01)

(58) Field of Classification Search
CPC ..... G04C 3/146; G04C 17/00; G04R 20/26; G04R 60/14; G04R 20/04; G04R 20/28; G04R 20/10; G04G 9/00; G04G 21/00; G04G 21/08
USPC ..... 368/76
See application file for complete search history.

(56) References Cited

U.S. PATENT DOCUMENTS 8,971,153 B2 * 3/2015 Takenawa ..... G04C 17/0058 368/35
9,760,063 B2 * 9/2017 Hasegawa ..... G04G 9/00
2017/0060094 A1 * 3/2017 Aihara ..... G04G 21/04

FOREIGN PATENT DOCUMENTS

WO WO 2014207220 A2 12/2014

OTHER PUBLICATIONS

International Search Report for PCT/CN2016/102641 Written Opinion of the ISA for PCT/CN2016/102641.

* cited by examiner

*Primary Examiner* — Edwin A. Leon
(74) *Attorney, Agent, or Firm* — Raymond A. Nuzzo

(57) ABSTRACT

An analog watch has a casing, a watch dial and a concentric shaft device having concentrically arranged shafts, wherein each shaft is driven by a corresponding stepper motor. An hour hand is connected to one shaft. A minute hand is connected to another shaft. A multi-function hand is connected to another shaft. A microcontroller outputs signals to control the stepper motors so as to control movement of the hour hand, minute hand and multi-function hand. A Bluetooth® circuit receives signals from a Bluetooth® communication device and feeds these signals to the microcontroller. The received signals define the date and time in a present time zone and a desired mode of operation of the analog watch that defines the function of the multi-function hand. The microcontroller uses the received signals to adjust the Real Time Clock and control the hour, minute and multi-function hands.

13 Claims, 8 Drawing Sheets

* GMT/24 Hrs marking on watch bezel
* Date marking on the outmost of the watch dial
* Alarm marking at the smallest circle of the watch dial

* GMT/24 Hrs marking on watch bezel
* Date marking on the outmost of the watch dial
* Alarm marking at the smallest circle of the watch dial

HYBRID ANALOG WATCH

STATEMENT OF GOVERNMENT INTEREST

Not applicable.

CROSS REFERENCE TO OTHER PATENT APPLICATIONS

None.

TECHNICAL FIELD

The present invention relates to a Bluetooth® enabled analog watch.

BACKGROUND

World travelers often need to know the time in more than one time zone. This is especially true for business people who are conducting business in one time zone but are dependent upon people and resources located in another time zone. World travelers also need correct date information at all times. Since world travelers pass through several time zones in just a few days, it is only natural that the travelers' sleeping schedule is interrupted. Travelers may find themselves sleeping at odd times throughout the morning and afternoon and at risk for oversleeping and missing important events.

Therefore, it is an object of the present invention to provide an analog watch that addresses all of the foregoing needs of world travelers.

SUMMARY

An analog quartz watch, comprising a casing, a watch dial supported by the casing and having indicia thereon comprising numerals and index hour markers arranged in consecutive order so as to represent time in hours and minutes and a concentric shaft device comprising a plurality of concentrically arranged shafts. The analog watch further comprises an hour hand connected to one of the shafts such that the hour hand can rotate over the watch dial, a first stepper motor to drive the shaft to which the hour hand is connected, a minute hand connected to one of the shafts such that the minute hand can rotate over the watch dial, a second stepper motor to drive the shaft to which the minute hand is connected, a multi-function hand connected to one of the shafts such that the multi-function hand can rotate over the watch dial, and a third stepper motor to drive the shaft to which the multi-function hand is connected. The analog quartz watch further comprises a microcontroller comprising a plurality inputs and outputs, a Real Time Clock, a memory, a digital signal processor and CPU. The microcontroller outputs separate control signals to control the first, second and third stepper motors so as to control movement of the hour hand, minute hand and multi-function hand. The analog watch further comprises a Bluetooth® circuit in electronic signal communication with the microcontroller. The Bluetooth® circuit is configured to be discovered by and paired with a Bluetooth® communication device so as to create a Bluetooth® communication link that enables the Bluetooth® circuit to receive RF signals from the Bluetooth® communication device. The Bluetooth® circuit converts the received RF signals into digital signals for input to the microcontroller. The digital signals define the date and time in a present time zone and a desired mode of operation of the analog watch. The microcontroller processes the digital signals to adjust or set the Real Time Clock to the current date and time and to control the movement of the hour and minute hands in accordance with the Real Time Clock and to control the movement of the multi-function hand in accordance with the desired mode of operation. The desired mode of operation determines the function of the multi-function hand. The Bluetooth® communication device can be a Bluetooth® capable communication device such as a smart phone, iPhone, iPad, tablet, PDA (i.e. personal digital assistant), etc.

An important aspect of the analog watch of the present invention is that it does not use a stem and crown to set the time or date. Instead, time and date information is inputted into the analog watch via a Bluetooth communication link with a communication device such as a smart phone, iPhone, iPad or other tablet, PDA, etc. A user downloads an App from a network service provider that establishes the Bluetooth communication link with the analog watch.

An important feature of the analog watch of the present invention is that it uses a third or multi-function hand that rotates about the same axis as the hour and minute hands of the analog watch. The particular function of the multi-function hand is selected by the user via the App on his or her smart communication device.

Another important feature of the analog watch is that is does not use gears or gear trains to drive the hour and minute hands and multi-function hand. Instead, the hour and minute hands and multi-function hand are driven by corresponding shafts which are directly driven by stepper motors.

DETAILED DESCRIPTION

As used herein, the term "index hour marker" shall mean a line, marker or indicator on a watch dial or bezel of an analog watch that is used in lieu of numerals to represent hours.

As used herein, the term "minute marker" shall mean a line, marker or indicator on a watch dial of analog watch that is used in lieu of numerals to represent minutes.

As used herein, the term "present time zone" shall mean the time zone in which a user (i.e. a person) is currently located.

Figure 1:
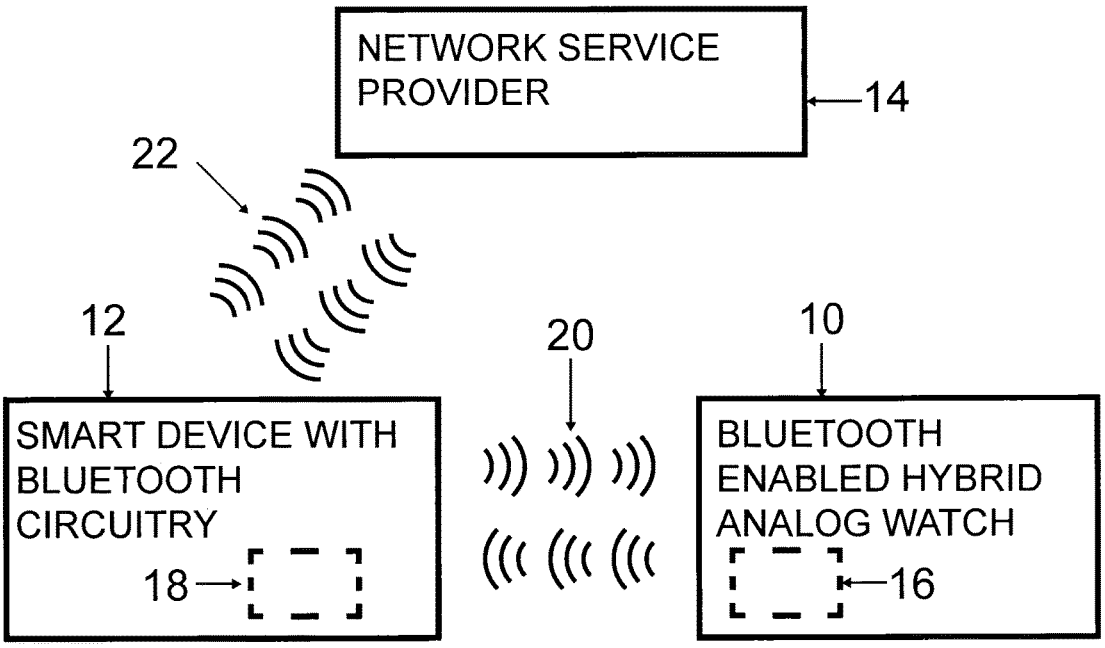
FIG. 1 is a block diagram illustrating the radio frequency (RF) communication between a network service provider and a mobile communication device, and between the mobile communication device and the Bluetooth® enabled analog watch of the present invention.

Referring to FIG. 1, there is shown a block diagram that illustrates RF communication between the Bluetooth® enabled analog quartz watch 10 of the present invention and a Bluetooth® mobile communication device 12, and RF communication between the mobile communication device 12 and a network service provider 14. Mobile communication device 12 can be any Bluetooth® mobile communication device such as a smart phone (e.g. iPhone), a tablet (e.g. iPad), Personal Digital Assistant (PDA), computer, etc. that is capable of Bluetooth® communication. Analog watch 10 comprises Bluetooth® circuitry 16 which is well known in the art. Mobile communication device 12 comprises Bluetooth® circuity 18 that enables pairing and communication with analog watch 10 via RF signals 20. Mobile communication device 12 communicates with network service provider 14 via RF signals 22. As will be explained in detail in the ensuing description, mobile communication device 12 downloads application software ("App") via network service provider 14. When the user implements the App, the mobile communication device 12 initiates Bluetooth® communication with analog watch 10. After mobile communication device 12 and analog watch 10 are Bluetooth ® paired, the mobile communication device 12 outputs Bluetooth RF signals that set the operational mode of analog watch 10. This feature is described in detail in the ensuing description.

Figure 2:
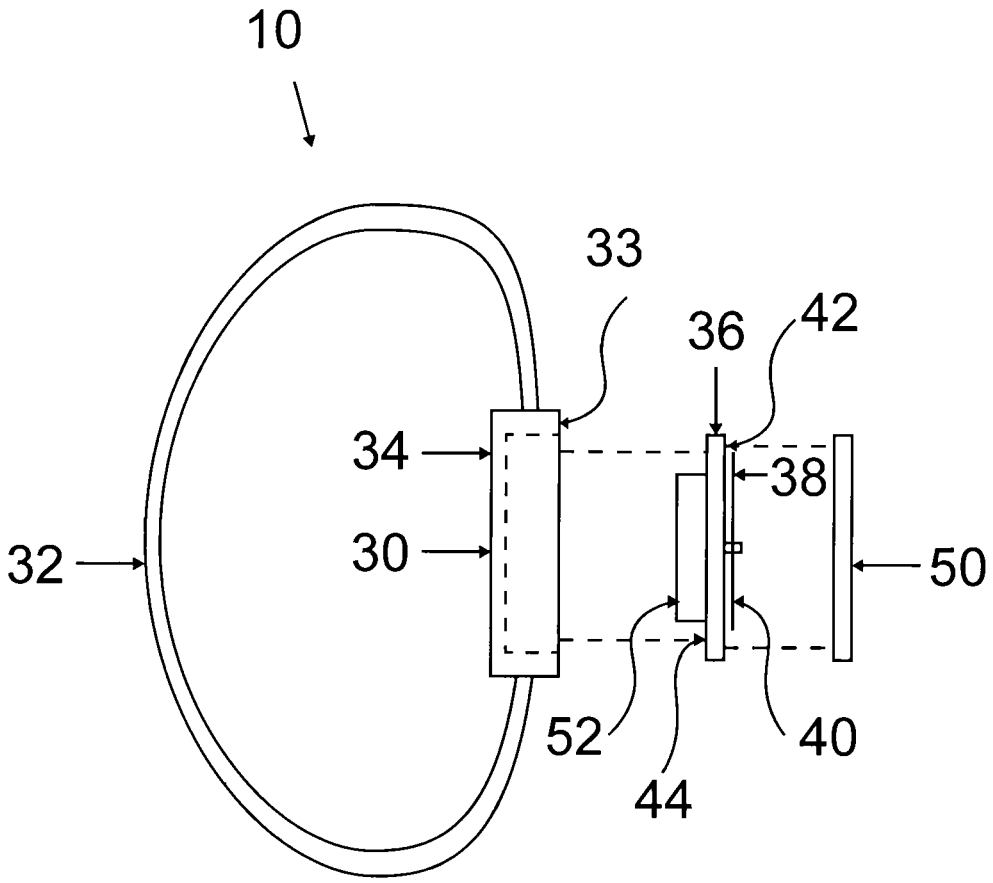
FIG. 2 is an exploded view of a Bluetooth® enabled analog watch in accordance with one embodiment of the invention.
Figure 3:
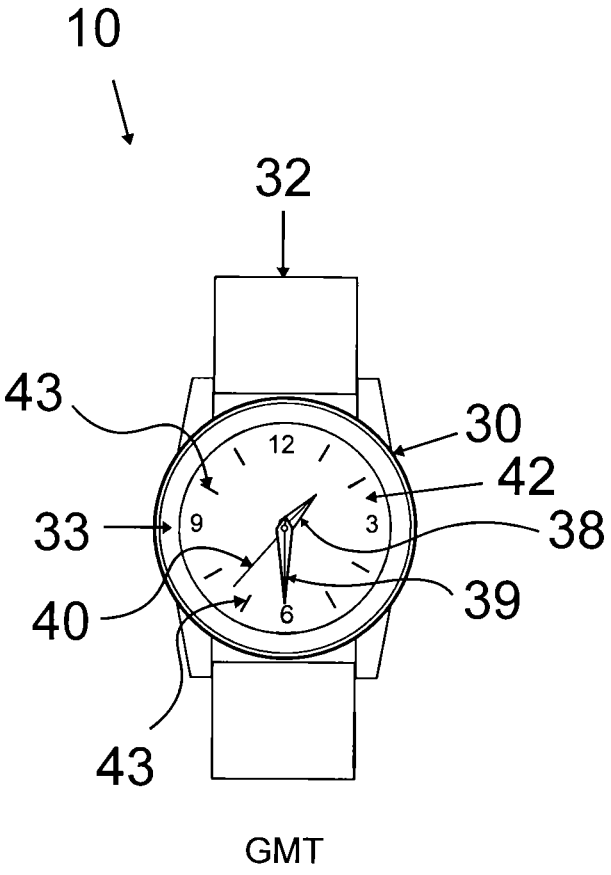
FIG. 3 is a front view of the Bluetooth® enabled analog watch of FIG. 2 completely assembled, the Bluetooth® enabled analog watch being configured to display both GMT and the current time in another time zone.

Referring to FIGS. 2 and 3, of the drawings, there is shown analog watch 10 in accordance with one embodiment of the present invention. Analog watch 10 comprises casing 30 and wrist band 32 which is attached to casing 30. Casing 30 includes bezel 33. Casing 30 has cavity or space 34 (shown in phantom) that is sized for receiving components of analog watch 10 as will be described in detail in the ensuing description. Analog watch 10 further comprises support member 36, hour hand 38 and minute hand 39. In accordance with the invention, analog watch 10 further comprises multi-function third hand 40. Support member 36 comprises watch dial 42 and rear side 44. The numbers twelve, three, six and nine, and index hour markers 43 are printed or formed on watch dial 42.

Due to the particular orientation of the view in FIG. 2, minute hand 39 cannot be seen. However, minute hand 39 is shown in FIG. 3. Analog watch 10 further comprises transparent cover 50 that is attached to casing 30. Transparent cover 50 may be fabricated from suitable materials such as sapphire, Plexiglass, transparent plastic, acrylic plastic, glass, etc. Cover 50 is not shown in FIG. 3 in order to facilitate viewing watch dial 36, hour hand 38, minute hand 39 and multi-function hand 40. Analog watch 10 further comprises components, indicated by reference number 52, that are mounted to rear side 44 of support member 42. As will be explained in the detailed explanation, components 52 comprise electronic and electro-mechanical components that drive hour hand 38, minute hand 39 and multi-function hand 40.

Referring back to FIGS. 1 and 4A-D, when a user implements the App, a Bluetooth® communication link is established between mobile communication device 12 and analog watch 10 which enables the user to set the operational mode of analog watch 10. In one embodiment of the invention, there are four modes of operation: GMT (Greenwich Mean Time) Analog Mode, GMT 24-Hour Mode, Date Mode and Alarm Mode. The App allows the user to use the mobile communication device 12 to select one of the modes of operation and transmit Bluetooth® signals that define the selected mode of operation to analog watch 10. Components 52 include Bluetooth® circuit 16 that receives the Bluetooth® signals transmitted by mobile communication device 12 and converts the received RF signals into digital signals. When analog watch 10 is fully assembled, components 52 are disposed within cavity 34 of casing 30 (see FIG. 2). Components 52 further include microcontroller unit (MCU) 100 and stepper motors 102, 104 and 106. MCU 100 outputs individual electronic signals to stepper motors 102, 104 and 106. Analog watch 10 includes a concentric shaft device that is shown in FIG. 4C and which comprises three geared shafts concentrically arranged. Such a concentric shaft device is known in the field of analog watches. This concentric shaft device includes a cannon pinion which is also well known in the art. FIG. 4D shows the geared shafts in phantom. The purpose of FIG. 4D is to provide a simple view showing the engagement of the gear of each stepper motor with a gear of a corresponding shaft. The concentric shaft device comprises shaft 80 which drives hour hand 38, shaft 81 which drives minute hand 39 and shaft 82 which drives multi-function hand 40. As known in the art, shafts 80, 81 and 82 have gears 90, 91 and 92, respectively, thereon. Each gear can be attached to the corresponding shafts or the gear can be integrally formed with the shaft. In accordance with the invention, each stepper motor 102, 104 and 106 has a motor shaft and a gear connected to the motor shaft. For example, FIG. 4B shows stepper motor 102 which has a shaft 102A and gear 102B connected to shaft 102A. In accordance with the invention, gear 102B of stepper motor 102 is engaged with gear 90 of shaft 80 so as to drive shaft 80 and cause rotation of hour hand 38. Similarly, the gear (not shown) on stepper motor 104 is engaged with gear 91 of shaft 81 so as to drive shaft 81 and cause rotation of minute hand 39. Similarly, the gear (not shown) on stepper motor 106 is engaged with gear 92 on shaft 82 so as to drive shaft 82 and cause rotation of multi-function hand 40. MCU 100 comprises a Real Time Clock (RTC) that can be synchronized with the current date and time information transmitted by the mobile communication device 12. MCU 100 further comprises a plurality of inputs and outputs, a digital signal processor, a central processing unit (CPU) and memory. In a preferred embodiment, the memory includes a flash memory. In one embodiment, the memory also includes read-only-memory (ROM) and random access memory (RAM). Bluetooth® circuit 16 converts the RF signals into digital signals which are then inputted into MCU 100. MCU 100 processes these digital signals and, in response, outputs digital control signals to stepper motors 102, 104 and 106 in accordance with the App selected by the user. MCU 100 includes crystal oscillator 110. Bypass capacitor 112 is electrically connected across the power supply voltage inputs of MCU 100 in order to shunt any stray RF signals and noise to electrical ground.

Figure 4A:
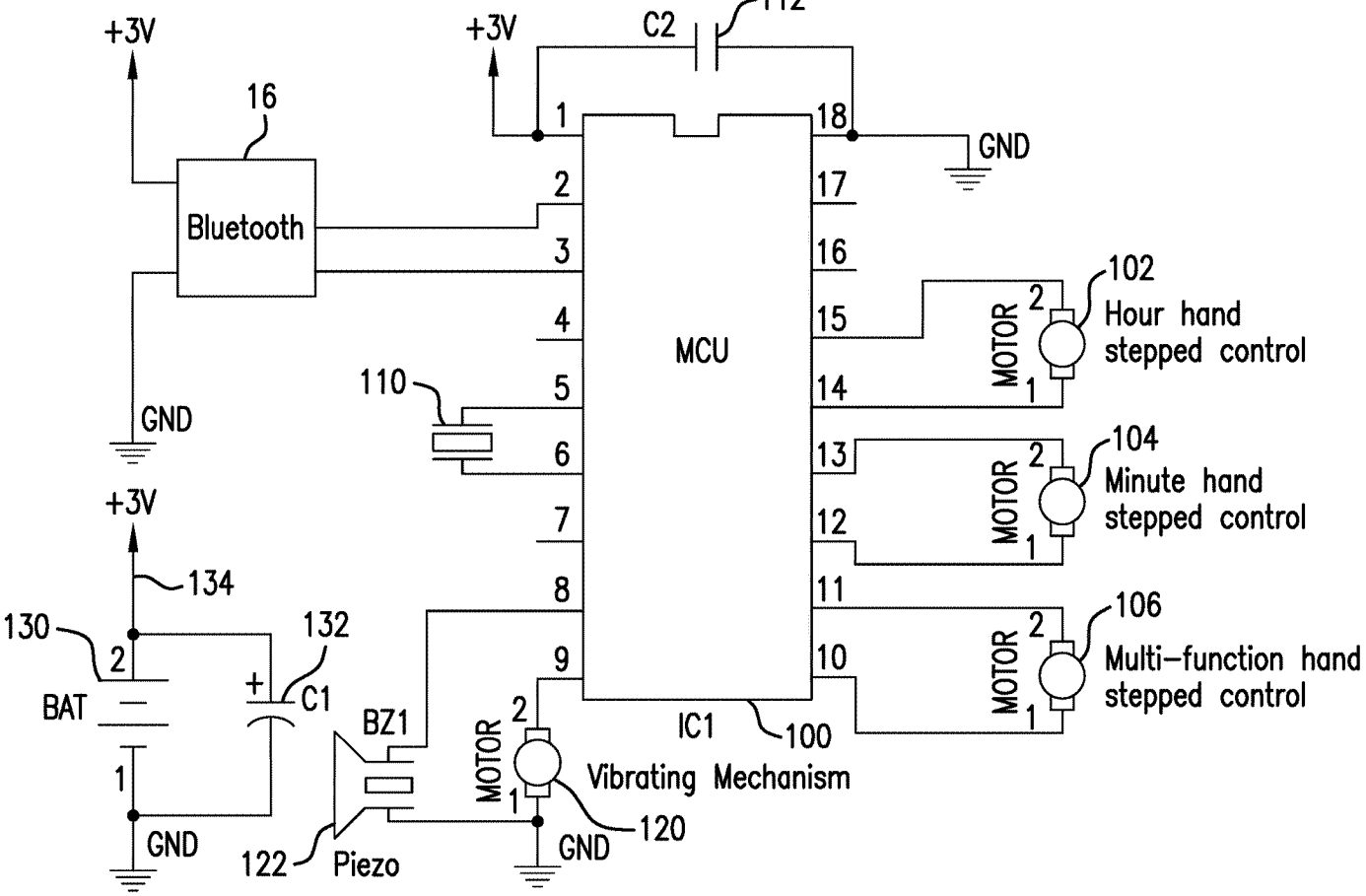
FIG. 4A is a schematic diagram of the components of the Bluetooth® enabled analog watch of FIG. 2 in accordance with one embodiment of the invention.
Figure 4B:
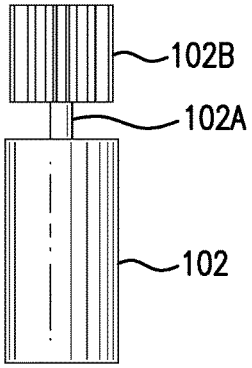
FIG. 4B is a diagram of one of the stepper motors shown in FIG. 4A, the stepper motor having a gear attached to the shaft of the stepper motor.
Figure 4C:
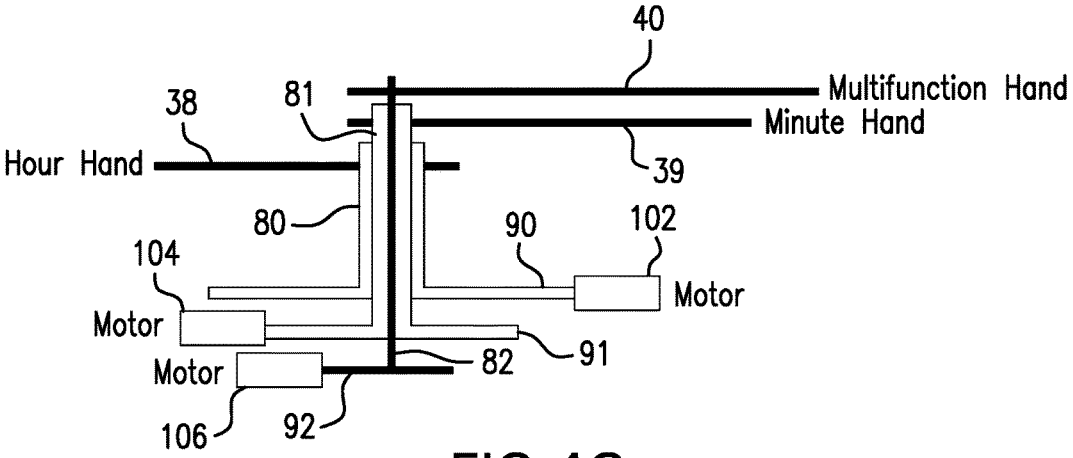
FIG. 4C is a diagram illustrating a concentric shaft device used in the analog watch of the present invention, the concentric shaft device comprising a plurality of geared shafts arranged concentrically, each geared shaft being driven by a corresponding stepper motor.
Figure 4D:
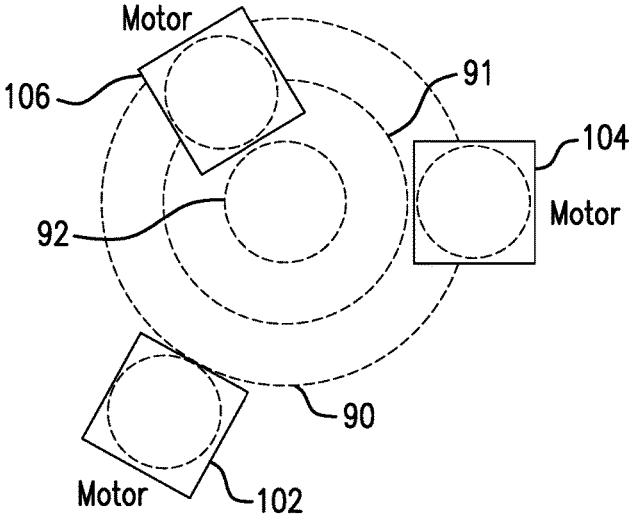
FIG. 4D is a diagram that illustrates the engagement of each stepper motor with a corresponding geared shaft.

Referring to FIG. 4A, analog watch 10 further stepper motor 120 and piezo alarm 122. Stepper motor 120 and piezo alarm 122 both function as alarms and work independently or in parallel. Stepper motor 120 is electrically connected to a corresponding signal output of MCU 100. Piezo alarm 122 is electrically connected to a corresponding signal output of MCU 100. When MCU 100 outputs digital signals to stepper motor 120, the stepper motor 120 produces vibrations which function as an alarm. When MCU 100 outputs digital signals to piezo alarm 122, the piezo alarm 122 produces an audio sound which functions as an alarm. Analog watch 10 includes battery 130 and bypass capacitor 132. Bypass capacitor 132 shunts any stray RF or noise signals on DC voltage line 134 to electrical ground.

Figure 5:
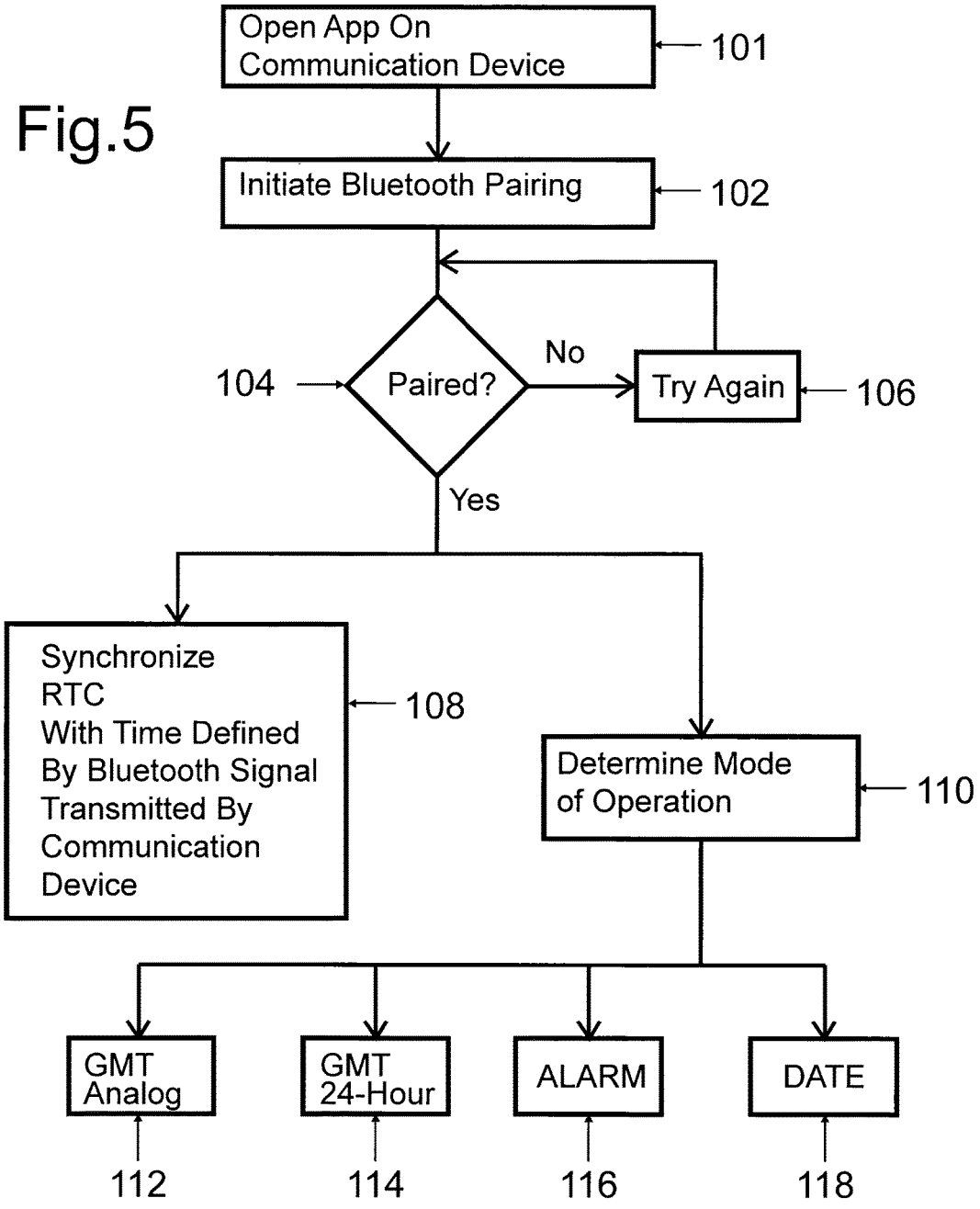
FIG. 5 is flow chart illustrating the steps of pairing and synchronizing a mobile communication device with the Bluetooth® enabled analog watch and configuring the Bluetooth® enabled analog watch to a desired mode of operation.

Referring to FIG. 3, there is shown analog watch 10 configured to operate in the GMT-Analog Mode of operation wherein multi-function hand 40 indicates GMT. In this embodiment, watch dial 42 of analog watch 10 has numerals twelve, three, six and nine hours, and index hour markers 43 to indicate numerals representing one, two, four, five, seven, eight, ten and eleven. Hour hand 38 and minute hand 39 indicate the current time in the present time zone and multi-function hand 40 indicates GMT. FIG. 5 is a flowchart of the steps involved in configuring analog watch 10 in the desired mode of operation. With respect to the embodiment shown in FIG. 3, the desired mode of operation is the GMT-Analog Mode of operation. In this example, the user has already used his or her mobile communication device 12 to download the App from network service provider 14. The process thus begins in step 100 wherein the user opens the App and is presented with a menu. The menu provides a list of modes of operation associated with analog watch 10. The user selects the GMT-Analog Mode of operation. In step 102, the Bluetooth® pairing process begins. In this step, mobile communication device 12 emits a Bluetooth® signal that enables Bluetooth® circuit 16 in analog watch 10. In response, Bluetooth® circuit 16 outputs a signal that is transmitted back to mobile communication device 12. When mobile communication device 12 receives and acknowledges this signal from Bluetooth® circuit 16, then mobile communication device 12 and analog watch 10 are paired, as indicated in step 104. If mobile communication device 12 does not receive and acknowledge the signal outputted by Bluetooth® circuit 16, then mobile communication device 12 repeats transmission of the enabling signal to analog watch 10 and waits for a return signal from Bluetooth® circuit 16, as indicated by step 106. Once mobile communication device 12 and analog watch 10 are Bluetooth® paired, mobile communication device 12 transmits signals that contain information and data representing the date, current time in the present time zone and the desired mode of operation. The desired mode of operation determines the function of multi-function hand 40, as indicated by steps 108 and 110. Bluetooth® circuit 16 in analog watch 10 converts the Bluetooth ® signals into digital signals that synchronize the Real Time Clock of MCU 100 with the date and current time in the present time zone. MCU 100 also processes the digital signals to determine the desired mode of operation. The determined mode of operation defines the function of multi-function hand 40. In this case, the desired mode of operation is the GMT-Analog Mode of operation (see step 112). In response, MCU 100 outputs signals that are inputted into to stepper motors 102 and 104 so as to position hour hand 38 and minute hands 39, respectively, to reflect the current time in the present time zone, and also outputs signals that are inputted into stepper motor 106 in order to control movement of multi-function hand 40 so that it indicates GMT. The RTC of MCU 100 allows the MCU 100 to continue to output signals to stepper motors 102 and 104 so that hour hand 38 and minute hands 39 indicate the correct time in the present time zone and the multi-function hand 40 indicates GMT. MCU 100 stores all commands in memory and therefore continues to operate in the selected mode of operation after the Bluetooth communication link between mobile communication device 12 and analog watch 10 is terminated.

Figures 6, 7, 8:
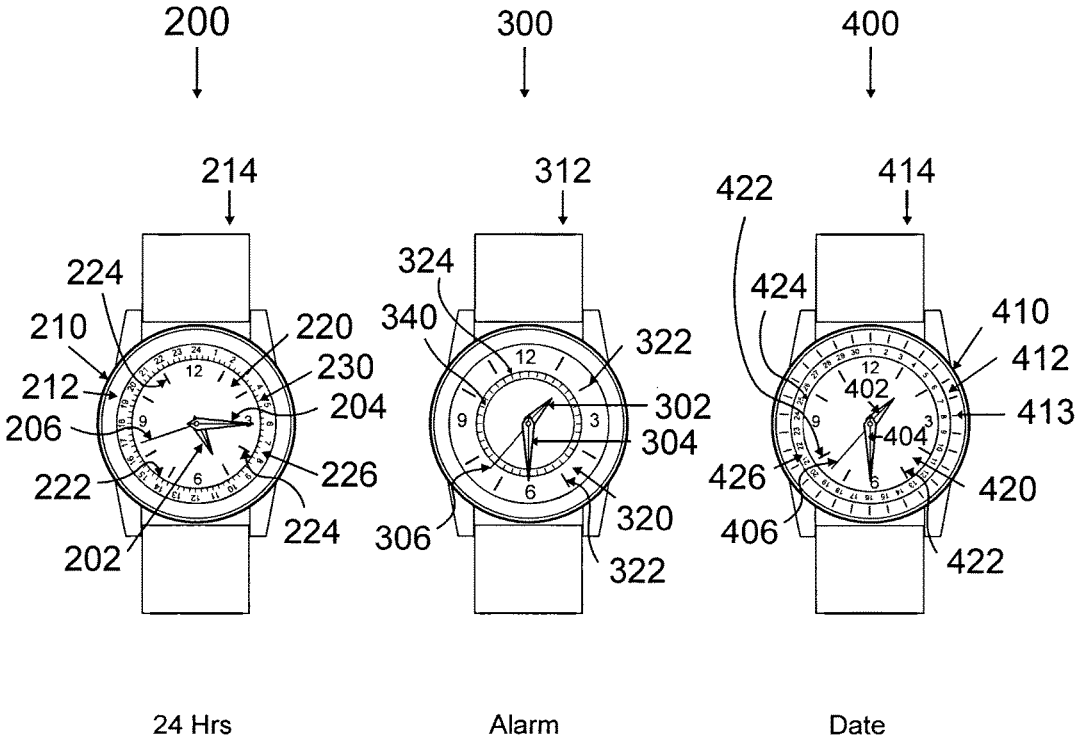
FIG. 6 is a front view of a Bluetooth® enabled analog watch in accordance with another embodiment of the invention.
FIG. 7 is a front view of a Bluetooth® enabled analog watch in accordance with a further embodiment of the invention
FIG. 8 is a front view of a Bluetooth® enabled analog watch in accordance with another embodiment of the invention.

Referring to FIG. 6, there is shown another embodiment of the analog watch of the present invention. Analog watch 200 is configured to display GMT based on 24-hour markers. Analog watch 200 has the same internal electronic and electromechanical components as analog watch 10. Thus, analog watch 200 includes Bluetooth® circuitry, a microcontroller unit (MCU) which provides the same functions as MCU 100, three stepper motors to drive hour hand 202, minute hand 204 and multi-function hand 206. Analog watch 200 also includes a battery power source which is substantially the same as battery power source 130 of analog watch 10. Analog watch 200 includes casing 210 which has bezel 212. Wrist band 214 is attached to casing 210. Analog watch 200 also has a transparent cover (not shown) which provides the same function as transparent cover 50. Analog watch 200 has a watch dial 220 which displays circle 222, the numerals twelve, three, six and nine within circle 222 and a plurality of index hour markers 224 within circle 222. The numerals twelve, three, six and nine and the plurality of index hour markers 224 are associated with hour hand 202 and minute hand 204. Watch dial 220 has an outer portion 226 that is between circle 222 and bezel 212. Watch dial 220 includes numerals 1-24 located on outer portion 226. Each numeral 1-24 functions as an hour marker wherein all numerals 1-24 represent a twenty-four hour period. Watch dial 220 further displays markers 230 that extend outward from circle 222 such that markers 230 are on outer portion 226. Markers 230 are associated with numerals 1-24. Markers 230 represent fifteen minute increments. Numerals 1-24 and markers 230 are associated with multi-function hand 206 and used to determine GMT. In accordance with this embodiment of the invention, hour hand 202 and minute hand 204 indicate the current time in the present time zone and multi-function hand 206 indicates GMT based on numerals 1-24 and markers 230. In order to configure analog watch 200 to provide the correct current time and GMT, the user uses his or her mobile communication device 12 to download the App as described in the foregoing description. The user then selects "GMT 24-Hour Mode" as the mode of operation. The mobile communication device 12 outputs Bluetooth® signals in order to enable the Bluetooth® circuit in analog watch 200 and initiate the Bluetooth® pairing process as described in the foregoing description. Once mobile communication device 12 and analog watch 200 are Bluetooth® paired, mobile communication device 12 transmits signals that contain information and data that represents the date, current time in the present time zone and the desire mode of operation. The Bluetooth® circuit in analog watch 200 converts the Bluetooth ® signal into digital signals that synchronize the Real Time Clock of the MCU in analog watch 200 with the date and current time in the present time zone. The MCU in analog watch 200 also processes the digital signals to determine the desired mode of operation. These steps are shown as steps 108 and 110 in FIG. 5. In this case, the desired mode of operation is the "GMT 24-Hour" mode of operation (see step 114 in FIG. 5). In response, the MCU in analog watch 200 outputs signals that are inputted into to the stepper motors to control hour hand 202 and minute hand 204, respectively, so that analog watch 200 displays the current time in the present time zone. The MCU of analog watch 200 also outputs signals that are inputted into the third stepper motor to control movement of multi-function hand 206 so that multi-function hand 206 indicates GMT using the numerals 1-24 and markers 230 on outer portion 226 of watch dial 220. The MCU in analog watch 200 then continues to control the stepper motors in analog watch 200 so that hour hand 202 and minute hands 204 continue to indicate the current time in the present time zone and multi-function hand 206 indicates GMT based on the numeral 1-24 and markers 230. The MCU in analog watch 200 stores all commands in memory and continues to operate in the selected mode of operation after the Bluetooth ® communication link between mobile communication device 12 and analog watch 400 is terminated.

Referring to FIG. 7, there is shown another embodiment of the analog watch of the present invention. Analog watch 300 is configured with the same electronic and electromechanical components shown in FIG. 4A. Analog watch 300 is configured to allow a user to set an alarm in analog watch 300. The alarm comprises a stepper motor and piezo alarm which function in the same manner as stepper motor 120 and piezo alarm 122, respectively, shown in FIG. 4A. Thus, analog watch 300 includes hour hand 302, minute hand 304 and multi-function hand 306. Analog watch 300 includes casing 310 and wrist band 312 that is attached to casing 310. Analog watch 300 also has a transparent cover (not shown) which provides the same function as transparent cover 50. Analog watch 300 has watch dial 320 that displays the numerals twelve, three, six and nine and a plurality of index hour markers 322. Analog watch 300 further displays a pair of concentric circles 324 and 326 that are positioned within the numerals twelve, three, six and nine and index hour markers 322. Watch dial 320 has markers 340 between circles 324 and 326. Each marker 340 represents a fifteen minute increment. In accordance with this embodiment of the invention, hour hand 302 and minute hand 304 indicate the current time and multi-function hand 306 indicates the time at which the alarm is set. In order to configure analog watch 300 to activate the alarm at the desired time, the user uses his or her mobile communication device 12 to download the App as described in the foregoing description. The user then selects "Alarm" as the mode of operation. The mobile communication device 12 outputs Bluetooth® signals in order to enable the Bluetooth® circuit in analog watch 300 and initiate the Bluetooth® pairing process as described in the foregoing description. Once mobile communication device 12 and analog watch 300 are Bluetooth® paired, mobile communication device 12 transmits signals that contain information and data that represents the date and current time in the present time zone and the desired mode of operation. The Bluetooth® circuit in analog watch 300 converts the Bluetooth ® signal into digital signals that synchronize the Real Time Clock of the MCU in analog watch 300 with the date and current time in the present time zone provided by the mobile communication device 12. The MCU in analog watch 300 also processes the digital signals that represent the desired function of multi-function hand 306. In this case, the desired mode of operation is the "Alarm" mode. The processed digital signals also define the desired time at which the alarm is to be activated (see steps 108, 110 and 116 in FIG. 5). In response, the MCU of analog watch 300 outputs signals that are inputted into to the stepper motors in order to control the movement of hour hand 302 and minute hand 304 so as to reflect the current time in the present time zone. The MCU of analog watch 300 outputs signals that are inputted into third stepper motor in order to control the movement of multi-function hand 306 so that multi-function hand 306 is positioned at the marker 340 that corresponds to the desired time at which the alarm is to be activated. For example, in FIG. 7, assuming the time shown is AM, multi-function hand 306 is positioned at the marker 340 that indicates 7:30 AM. This means that the alarm is set for 7:30 AM. Therefore, at 7:30 AM, the MCU of analog watch 300 outputs a signal that causes activation of the alarm (i.e. stepper motor and piezo alarm) in analog watch 300. The MCU in analog watch 300 stores all commands in memory and therefore continues to operate in the selected mode of operation after the Bluetooth ® communication link between mobile communication device 12 and analog watch 300 is terminated.

Referring to FIG. 8, there is shown another embodiment of the analog watch of the present invention. Analog watch 400 is configured with all of the same electronic and electromechanical components shown in FIG. 4A. Analog watch 400 is configured to display the date and current time in the present time zone. Mobile communication device 12 establishes a Bluetooth ® communication link with analog watch 400 in the same manner as described for the foregoing embodiments. Analog watch 400 comprises casing 410 which has bezel 412. Wrist band 414 is attached to casing 410. Analog watch 400 includes hour hand 402, minute hand 404 and multi-function hand 406. Analog watch 400 also has a transparent cover (not shown) which provides the same function as transparent cover 50. Bezel 412 has a thirty-one equidistantly spaced date markers formed or printed thereon. Analog watch 400 has a watch dial 420 that displays the numerals twelve, three, six and nine and a plurality of index hour markers 422. Watch dial 420 displays a circle 424 that envelopes the numerals twelve, three, six and nine and index hour markers 422. Watch dial 420 has portion 426 that is between circle 424 and bezel 412 and circumferentially extends about circle 424. The numbers 1-31 are printed or formed on portion 426. Numbers 1-31 represent thirty one days in a month. Each number 1-31 corresponds to a date marker on bezel 412. In accordance with this embodiment of the invention, hour hand 402 and minute hand 404 indicate the current time in the present time zone and multi-function hand 406 indicates the date. The user downloads the App on his or her mobile communication device 12 as described in the foregoing description. The user uses mobile communication device 12 to establish a Bluetooth ® communication link with analog watch 400 in the same manner as described for the foregoing embodiments. When mobile communication device 12 and analog watch 400 are paired, the user selects "Date Mode" as the desired mode of operation. Mobile communication device 12 then transmits Bluetooth® signals to analog watch 400. The Bluetooth® circuit in analog watch 400 converts the Bluetooth ® signal into digital signals that synchronize the Real Time Clock of the MCU in analog watch 400 with the date and current time in the present time zone. The MCU in analog watch 400 also processes the digital signals that represent the desired mode of operation. In this embodiment, the desired mode of operation is "Date Mode" which means the function of multi-function hand 406 is to indicate the date (see steps 108, 110 and 118 in FIG. 5). As a result, the MCU in analog watch 400 controls hour hand 402 and minute hand 404 to indicate the current time in the present time zone and controls multi-function hand 406 to indicate the date. As shown in FIG. 8, multi-function hand 406 is positioned at the numeral "19" indicating that the date is the $19^{th}$ of the month. The MCU in analog watch 400 stores all commands in memory and therefore continues to operate in the selected mode of operation after the Bluetooth ® communication link between mobile communication device 12 and analog watch 400 is terminated.

Figure 9:
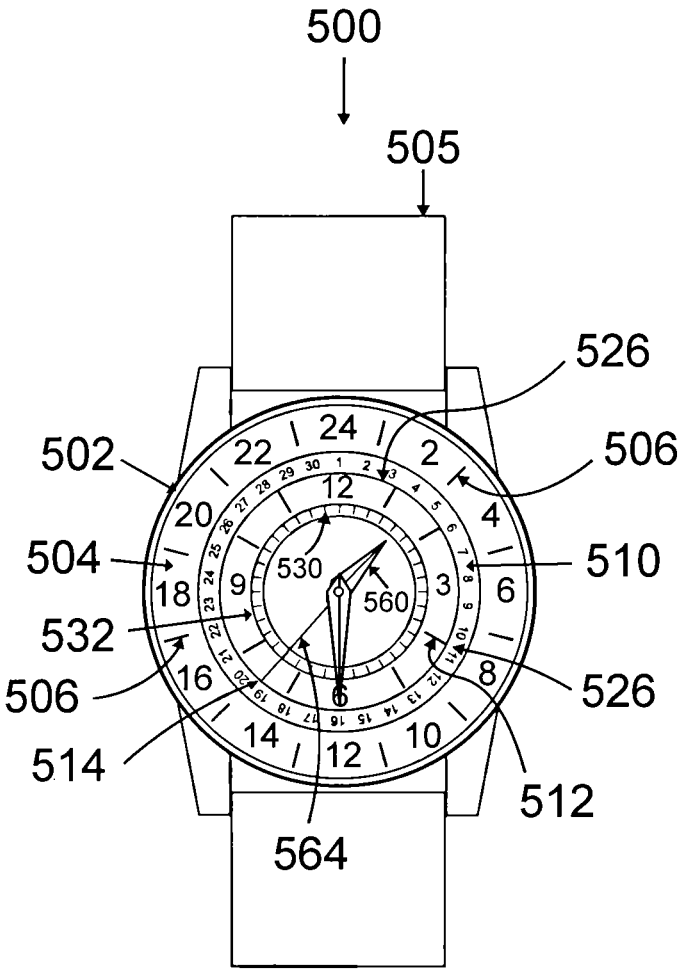
FIG. 9 is a front view of a Bluetooth® enabled analog watch in accordance with a further embodiment of the invention.

Referring to FIG. 9, there is shown Bluetooth® enabled analog watch 500 in accordance with another embodiment of the present invention. Analog watch 500 is configured to implement the "Alarm", "Date" and "GMT 24-Hour" modes of operation. Analog watch 500 comprises all of the components shown in FIG. 4A. A Bluetooth® communication link is established between mobile communication device 12 and analog watch 500 in the same manner as described for the foregoing embodiments. Analog watch 500 comprises casing 502 which has bezel 504. Bezel 504 has formed or printed thereon all even numbers between the numbers k1-24, inclusive. Bezel 504 also has index hour markers 506 formed or printed thereon. Each index hour marker 506 is between a pair of even numbers. The even numbers between 1-24, inclusive, and index hour markers 506 cooperate to define a 24 hour period. Analog watch 500 further comprises watch dial 510 that comprises the numerals 12, 3, 6 and 9 and index hour markers 512. Numerals 12, 3, 6 and 9 provide the same function as numerals 12, 3, 6 and 9 shown in FIG. 6. Index hour markers 512 perform the same function as index hour markers 224 shown in FIG. 6. Watch dial 510 further comprises circle 514 that envelopes the numerals 12, 3, 6 and 9 and index hour markers 512. Watch dial 510 has portion 526 that is between circle 514 and bezel 504 and circumferentially extends about circle 514. The numbers 1-31 are printed or formed on portion 526. The numbers 1-31 represent thirty one days in a month. Watch dial 510 further displays a pair of concentric circles 530 and 532 that are positioned within the numerals 12, 3, 6 and 9 and index hour markers 512. Watch dial 510 has markers 540 between circles 530 and 532. Each marker 540 represents a fifteen minute increment. Hour hand 560 and minute hand 562 indicate the time in the present time zone by their position in relation to the hour numerals 12, 3, 6, and 9 and index hour markers 512. The function of multi-function hand 564 depends upon the mode of operation selected by the user when he or she opens up the App on mobile communication device 12. If the user selects "GMT 24-Hour" mode of operation, then the MCU in analog hybrid watch 500 outputs signals to the stepper motors that cause hour hand 560 and minute hand 562 to indicate the time in the present time zone and cause multi-function hand 564 to indicate GMT via the even numbers and index hour markers 506 on bezel 504. If the user selects "Alarm" as the mode of operation, then the MCU in analog hybrid watch 500 outputs signals to the stepper motors that cause hour hand 560 and minute hand 562 to indicate the time in the present time zone and cause multi-function 564 to indicate, via the markers 540 between concentric circles 530 and 532, the time at which the alarm in analog watch 500 is to activated. If the user selects "Date" as the mode of operation, then the MCU in analog hybrid watch 500 outputs signals to the stepper motors that cause hour hand 560 and minute hand 562 to indicate the time in the present time zone and cause multi-function 564 to indicate the current date via the numerals 1-31 in portion 526 of watch dial 510. The MCU in analog watch 500 stores all commands in memory and therefore continue to operate in the selected mode of operation after the Bluetooth 8 communication link between mobile communication device 12 and analog watch 500 is terminated.

In all of the embodiments described in the forgoing description, the indicia, numerals, index hour markers and index minute markers are printed on the watch dial. However, the indicia can be formed by other suitable techniques as well, such as engraving, etching, painting, etc.

In all embodiments described in foregoing description, the microcontroller (MCU) is a commercially available 8-bit or 16-bit programmable microcontroller. Suitable microcontrollers are manufactured by Intel, Inc., Analog Devices, Inc. and Texas Instruments, Inc.

The Bluetooth® circuitry in the analog watches of the present invention may be configured as Bluetooth® Low Energy circuitry.

An important advantage of the analog watch of the present invention is that it does not utilize a crown and stem to set the time and date as do conventional analog watches. In the analog watch of the present invention, the time, date and alarm are set through the user commands defined by the Bluetooth® RF signals transmitted by the user's Bluetooth® capable communication device.

The analog watch of the present invention may be implemented as one watch that performs all of the modes of operation, or as separate, dedicated analog watches wherein each watch is configured so that it is dedicated to just one of the modes of operation.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. An analog watch, comprising:

a casing;

a watch dial supported by the casing and having indicia thereon comprising numerals and index hour markers arranged in consecutive order so as to represent time in hours and minutes;

a concentric shaft device comprising a plurality of concentrically arranged shafts;

an hour hand connected to one of the shafts such that the hour hand can rotate over the watch dial;

a first stepper motor to drive the shaft to which the hour hand is connected;

a minute hand connected to one of the shafts such that the minute hand can rotate over the watch dial;

a second stepper motor to drive the shaft to which the minute hand is connected;

a multi-function hand connected to one of the shafts such that the multi-function hand can rotate over the watch dial;

a third stepper motor to drive the shaft to which the multi-function hand is connected;

a microcontroller comprising a plurality inputs and outputs, a Real Time Clock, a memory, a digital signal processor and CPU, wherein said microcontroller outputs separate control signals to control the first, second and third stepper motors so as to control movement of the hour hand, minute hand and multi-function hand;

a wireless communication circuit in electronic signal communication with the microcontroller, the wireless communication circuit being configured to be discovered by and paired with a wireless communication device so as to create a wireless communication link that enables the wireless communication circuit to receive RF signals from the wireless communication device, the wireless communication circuit converting the received RF signals into digital signals for input to the microcontroller, the digital signals defining the date and time in a present time zone and a desired mode of operation of the analog watch which defines the function of the multi-function hand; and;

wherein the microcontroller processes the digital signals to adjust or set the Real Time Clock to the current date and time and to control the movement of the hour and minute hands in accordance with the Real Time Clock and to control the movement of the multi-function hand in accordance with the desired mode of operation.

2. The analog watch according to claim 1 wherein one desired mode of operation is an "Alarm" mode of operation and wherein the analog watch further comprises an alarm circuit in electronic signal communication with the microcontroller, wherein the microcontroller outputs control signals to the third stepper motor to position the multi-function hand at the indicia representing the time at which the alarm circuit is to activated.

3. The analog watch according to claim 1 wherein one desired mode of operation is a "Date" mode of operation and wherein the indicia on the watch dial further comprises indicia representing the date, wherein the microcontroller outputs control signals to the third stepper motor to position the multi-function hand at the indicia representing the date in the present time zone.

4. The analog watch according to claim 1 wherein one desired mode of operation is a "GMT" mode of operation and wherein the microcontroller outputs control signals to the third stepper motor to control the movement of the multi-function hand so that the multi-function hand is positioned at the indicia that indicates GMT.

5. The analog watch according to claim 4 wherein the watch dial includes additional indicia comprising numerals 1-24 arranged in consecutive order so as to represent 24 hours and wherein the microcontroller outputs control signals to the third stepper motor to control the movement of the multi-function hand so that the multi-function hand indicates GMT based on its position with respect to the additional indicia.

6. The analog watch according to claim 1 wherein the casing comprises a bezel having thereon numerals and index hour markers that represent 24 hours, wherein one of the desired modes of operation is a "GMT" mode of operation and the microcontroller outputs control signals to the third stepper motor to control the movement of the multi-function hand so that the multi-function hand indicates GMT based on the position of the multi-function hand with respect to the numerals and index hour markers on the bezel.

7. The analog watch according to claim 1 wherein each shaft has a gear attached thereto.

8. The analog watch according to claim 7 wherein each stepper motor includes a shaft and a gear connected to the shaft, the gear of each stepper motor being configured to engage the gear of a corresponding shaft.

9. The analog watch according to claim 1 wherein the microcontroller is configured to continue to control the stepper motors based on the information contained in the RF signals received from the wireless communication device after the wireless communication link with the wireless communication device is terminated.

10. The analog watch according to claim 1 wherein the indicia is printed on the watch dial.

11. The analog watch according to claim 5 wherein the additional indicia is printed on the watch dial.

12. The analog watch according to claim 6 wherein the numerals are printed on the bezel.

13. The analog watch according to claim 6 wherein the numerals are engraved on the bezel.

* * * * *